US008448338B2

(12) United States Patent
Sherman et al.

(10) Patent No.: US 8,448,338 B2
(45) Date of Patent: May 28, 2013

(54) RAZOR COMPRISING A THREE DIMENSIONAL, MICROSTRUCTURED ABRASION MATERIAL

(75) Inventors: Faiz Fiesal Sherman, Mason, OH (US); Vladimir Gartstein, Mason, OH (US); Roy Nicoll, Winnersh (GB); Matthias Gester, Farnborough (GB)

(73) Assignee: The Gillette Company, Boston, MA (US)

( * ) Notice: Subject to any disclaimer, the term of this patent is extended or adjusted under 35 U.S.C. 154(b) by 189 days.

(21) Appl. No.: 12/516,578

(22) PCT Filed: May 13, 2009

(86) PCT No.: PCT/US2009/043735

§ 371 (c)(1),
(2), (4) Date: Nov. 8, 2010

(87) PCT Pub. No.: WO2009/142972

PCT Pub. Date: Nov. 26, 2009

(65) Prior Publication Data

US 2011/0041340 A1 Feb. 24, 2011

Related U.S. Application Data

(60) Provisional application No. 61/055,599, filed on May 23, 2008.

(51) Int. Cl.
*B26B 21/40* (2006.01)

(52) U.S. Cl.
USPC ..... 30/34.05; 30/50

(58) Field of Classification Search
USPC ..... 30/50, 34.05, 32, 537
See application file for complete search history.

(56) References Cited

U.S. PATENT DOCUMENTS

| | | | | |
|---|---|---|---|---|
| 3,933,560 | A | 1/1976 | Muttera | |
| 3,939,560 | A * | 2/1976 | Lyall | 30/34.2 |
| 4,998,347 | A * | 3/1991 | Schachter | 30/34.2 |
| 5,100,506 | A * | 3/1992 | Sturtevant et al. | 216/47 |
| 5,347,716 | A * | 9/1994 | Crook | 30/77 |
| 5,512,219 | A * | 4/1996 | Rowland et al. | 264/1.6 |
| 5,953,619 | A | 9/1999 | Miyazawa et al. | |
| 6,200,399 | B1 | 3/2001 | Thielman | |
| 6,499,218 | B2 * | 12/2002 | Rocha | 30/41 |

(Continued)

FOREIGN PATENT DOCUMENTS

WO WO 2005/018884 A2 8/2004

OTHER PUBLICATIONS

PCT International Search Report for PCT/US2009/043735, dated May 13, 2009.

*Primary Examiner* — Sean Michalski
(74) *Attorney, Agent, or Firm* — Kevin C. Johnson; Steven W. Miller

(57) ABSTRACT

A wet shaving razor comprising a handle having a proximate and distal end, a razor cartridge mounted at the proximate end of the handle. The cartridge further includes 1) a housing having a front wall, a rear wall, and opposing side walls joining said front and rear walls; 2) a plurality of razor blades, each blade having a sharpened cutting edge and wherein said blades are disposed in a parallel arrangement extending between said side walls; and 3) an abrasion material comprising a plurality of geometric, three-dimensional, microstructures wherein said material is disposed adjacent to said front wall and forward of said blades.

11 Claims, 5 Drawing Sheets

U.S. PATENT DOCUMENTS

| | | | | |
|---|---|---|---|---|
| 6,568,082 | B2 * | 5/2003 | Pouettre et al. | 30/41 |
| 6,792,682 | B2 * | 9/2004 | Follo et al. | 30/50 |
| 6,807,739 | B2 * | 10/2004 | Follo | 30/527 |
| 6,821,281 | B2 * | 11/2004 | Sherman et al. | 606/131 |
| 7,007,393 | B2 | 3/2006 | Guimont | |
| 7,131,987 | B2 * | 11/2006 | Sherman et al. | 604/290 |
| 7,367,125 | B2 * | 5/2008 | Aviza | 30/34.05 |
| 2002/0045907 | A1 * | 4/2002 | Sherman et al. | 606/131 |
| 2002/0177858 | A1 * | 11/2002 | Sherman et al. | 606/131 |
| 2003/0213129 | A1 * | 11/2003 | Nicolosi et al. | 30/32 |
| 2003/0220656 | A1 * | 11/2003 | Gartstein et al. | 606/131 |
| 2004/0088863 | A1 | 5/2004 | Guimont | |
| 2004/0181943 | A1 * | 9/2004 | Kwiecien | 30/41 |
| 2004/0187319 | A1 | 9/2004 | Balistee et al. | |
| 2005/0066526 | A1 | 3/2005 | Guimont | |
| 2005/0090803 | A1 * | 4/2005 | Sherman et al. | 604/500 |
| 2005/0126007 | A1 | 6/2005 | Aviza | |
| 2005/0235495 | A1 | 10/2005 | Aviza et al. | |
| 2006/0032060 | A1 | 2/2006 | Nicolosi et al. | |
| 2006/0130627 | A1 * | 6/2006 | Matsuki et al. | 83/835 |
| 2006/0149297 | A1 * | 7/2006 | Sherman et al. | 606/131 |
| 2007/0227006 | A1 | 10/2007 | Aviza et al. | |
| 2011/0046638 | A1 * | 2/2011 | Gartstein et al. | 606/131 |

* cited by examiner

RAZOR COMPRISING A THREE DIMENSIONAL, MICROSTRUCTURED ABRASION MATERIAL

CROSS REFERENCE TO RELATED APPLICATIONS

This application claims the benefit of U.S. Provisional application No. 61/055,599, filed May 23, 2008.

FIELD OF THE INVENTION

The present invention relates to a wet shaving razor including an abrasion material comprising a plurality of geometric, three-dimensional, microstructures wherein said material is disposed adjacent to said front wall and forward of said blades wherein said abrasion material.

BACKGROUND OF THE INVENTION

In the common practice of shaving hair, a user removes a small portion of the outer layers of skin along with the hair that is cut resulting in a smoother and shinier skin appearance. It has been known in the art to exfoliate skin with abrasive material comprising particulates, e.g. sand, ground shells, seeds, kernels, beads, polymeric particles, etc., prior to or while shaving as detailed in US Patent Publications 2007/0227006 A1 and 2004/0181943 A1 and even as far back as the issuance of U.S. Pat. No. 3,939,560. In other approaches, shavers have been introduced to shaving implements that do not include typical razor blades. For instance, U.S. Pat. No. 7,007,393 B2, issued to Guimont on Mar. 7, 2006, discloses a microreplicated shaving elements that define cutting edges spaced away from a substrate's surface in combination with a plurality of guard elements attached to and extending outwardly from the substrate. Similarly, US Patent Publication 2006/003060 A1 filed in the name of Nicolosi et al. and published on Feb. 16, 2006, discloses a microprismatic shaving element for abrasively removing hair where it includes a substrate having a plurality of contiguous raised portions projecting outwardly therefrom. When this shaving element is used during a shaving operation, the contiguous raised portions defining the abrasive surface engage the hair protruding from a user's skin and abrade portions of the hair away, leaving a frayed hair end that is tactilely smooth and gives a feel of a close shave. Another reference, US Patent Publication 2005/0235495 A1 relates to a wet shaving system that includes blades mounted on a housing that further includes an exfoliation member and a drive mechanism that provides repeating movement to the exfoliating member. Additionally, US Patent Publication 2002/0177858 A1 relates to an apparatus involving a substrate with a plurality of microelements affixed to the substrate for scraping skin cells from the surface of the skin and methods of using such an apparatus. None of these references, however, capitalizes on the benefit of combining a plurality of razor blades with an abrasion material of the type Applicant describes herein in an integrated wet shaving razor. As a consequence, Applicant seeks to provide a wet shaving razor that not only provides a feeling of a "close" shave but rather an actually closer shave than would be achieved without razor blades or without incorporating an abrasive material as described herein.

SUMMARY OF THE INVENTION

The present invention relates to a wet shaving razor comprising:

a. a handle having a proximate and distal end;
b. a razor cartridge mounted at the proximate end of said handle, said cartridge further comprising
   1) a housing having a front wall, a rear wall, and opposing side walls joining said front and rear walls;
   2) a plurality of razor blades, each blade having a sharpened cutting edge and wherein said blades are disposed in a parallel arrangement extending between said side walls;
   3) an abrasion material comprising a plurality of geometric, three-dimensional, microstructures wherein said material is disposed adjacent to said front wall and forward of said blades.

The present invention also relates to a wet shaving razor comprising:

a. a handle having a proximate and distal end;
b. a razor cartridge mounted at the proximate end of said handle, said cartridge further comprising
   1) a housing having a front wall, a rear wall, and opposing side walls joining said front and rear walls;
   2) a plurality of razor blades, each blade having a sharpened cutting edge and wherein said blades are disposed in a parallel arrangement extending between said side walls;
   3) an abrasion material comprising a plurality of geometric, three-dimensional, microstructures wherein said material is disposed adjacent a side wall and along said blades.

The present invention further relates to a wet shaving razor comprising:

a. a handle having a proximate and distal end;
b. a razor cartridge mounted at the proximate end of said handle, said cartridge further comprising
   1) a housing having a front wall, a rear wall, and opposing side walls joining said front and rear walls;
   2) a plurality of razor blades, each blade having a sharpened cutting edge and wherein said blades are disposed in a parallel arrangement extending between said side walls; and 3) an abrasion material comprising a plurality of geometric, three-dimensional, microstructures wherein said material is disposed adjacent to said rear wall and rearward of said blades.

DETAILED DESCRIPTION OF THE INVENTION

Figure 1:
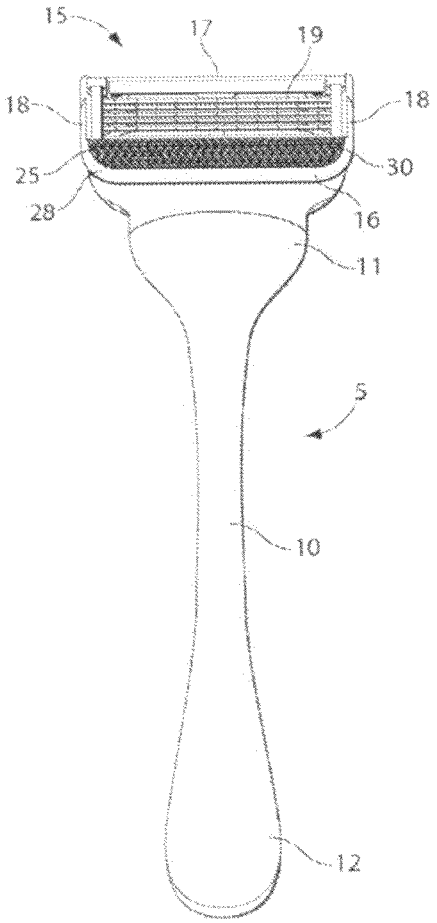
FIG. 1 shows a front view of the razor of the present invention.
Figure 2:
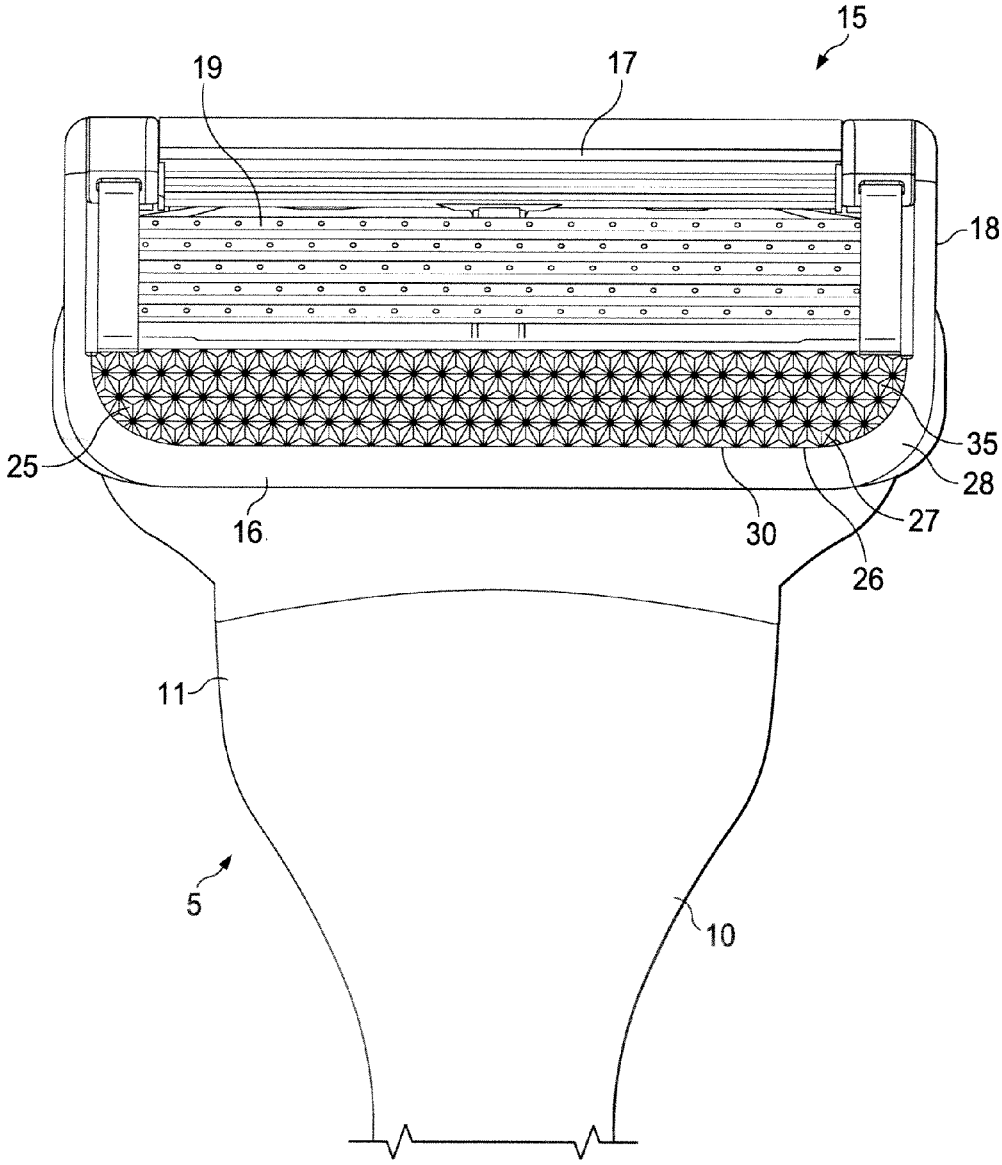
FIG. 2 shows a close up front view of the cartridge of the above razor.

The present invention is directed to a razor that is able to provide an improved closer shave to skin covered with hair by abrading the skin and/or hair prior to shaving with a particularly well-suited abrasion material. Referring to FIGS. 1 and 2, a wet shaving razor 5 includes a handle 10 having a proximate end 11 and a distal end 12. A razor cartridge 15 is mounted at the proximate end 11 and further comprises a housing having a front wall 16, a rear wall 17, and opposing side walls 18 which joint the front wall 16 and rear wall 17 to one another. A plurality of razor blades 19 are disposed in a parallel arrangement extending between the side walls 18. Each of these razor blades 19 has a sharpened cutting edge 20 on a forward facing surface of the blade. The cutting edges are useful for engaging and cutting hair on the skin to be shaved. The razor cartridge 15 further includes an abrasion material 25 which comprises a plurality of geometric, three-dimensional, microstructures 30. This abrasion material 25 is disposed adjacent to the front wall 16 and forward of the plurality of razor blades 19. In certain embodiments, the abrasion material 25 may comprise a base substrate 26 and a coating 27. The base substrate 26 serves to provide a formation material for the three-dimensional, microstructures 30. The base substrate may also act as a first source of light reflection in addition to the coating. The base substrate may comprise materials selected from the group consisting of polyurethane, aluminum, polypropylene, stainless steel, glass, acrylic, polyimide, polyetheretherketone, biopolymer, and combinations thereof. In certain embodiments, the base substrate may comprise materials that enable the microstructures to slowly wear away or dissolve to some extent to mark the end of life of the cartridge into which it is incorporated. Moreover, the base substrate may be impregnated with certain actives that are useful for providing various benefits to the skin being shaved. For instance, the base substrate may be impregnated with an active selected from the group consisting of antibacterial agents, skin conditioning agents, anti-inflammatory agents, and combinations thereof. Such agents may be leached from the base substrate during use to deposit onto the skin.

The coating 27 may act as a barrier by preventing leakage of monomers from the base layer from contacting skin when the razor is exposed to water during shaving. The coating 27, like the base substrate, may also act as a reflector of light to enhance the aesthetic appearance of the razor cartridge 15 of the razor 5. The coating 27 may comprise materials selected from the group consisting of aluminum, nickel, chromium, water- or other solvent based inks or paints, and combinations thereof. Also, like the base substrate, the coating may be impregnated with the agents mentioned above in order to provide a benefit to the skin and/or hair being shaved. The abrasion material 25 may be joined to the housing using a number of conventionally known attachment mechanisms including, but not limited to, adhesive attachment, injection molding, ultrasonic bonding, insert molding, over-molding, and combinations thereof. In this embodiment, the abrasion material 25 is substantially surrounded by a guard bar 28. As used herein, "substantially surrounded" means that the guard bar abuts at least two sides of the abrasion material on the cartridge. In certain embodiments, the guard bar may even abut three or four sides, e.g., the full periphery, of the abrasion material. The guard bar may be formed of elastomeric material, rigid material, or a combination thereof. The orientation of the guard bar with respect to the blade edges may be coplanar or straight at an angle or curved. The guard bar may also comprise elastomeric fins in addition to the abrasion material to heighten the uplift of skin cells and hair prior to shaving.

Figure 3:
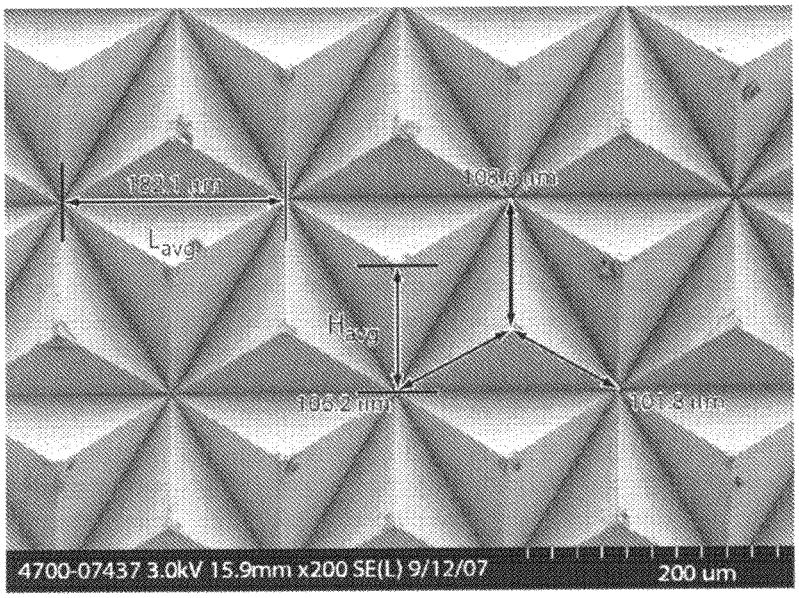
FIG. 3 shows a top view photomicrograph of the abrasion material incorporated into the above razor.

The microstructures provide a three-dimensional texture to the abrasion material and thereby serve to exfoliate the skin and uplift the hair that is about to be shaved. The three-dimensional shapes that make up the abrasion material may comprise polyhedrons, hemispheres, cones, cubes, cylinders, and combinations thereof. In particular, the polyhedrons may be selected from the group consisting of pyramids, tetrahedrons, pentahedrons, hexahedrons, septahedrons, octahedrons, and combinations thereof. These three-dimensional shapes may vary in length and height. In certain embodiments, the microstructures may have an average base surface length, $L_{avg}$, of less than about 500 μm, of less than about 400 μm, of less than about 300 μm, of less than about 250 μm, of less than about 200 μm, of less than about 100 μm, or even of less than about 50 μm. In one embodiment the average base surface length is about 180 μm. FIG. 3 indicates at least one of the lengths that serves as a base surface length used to determine the average base surface length. Also, in FIG. 3, the average height of the microstructures is shown. The height spans from the base surface length to a top surface of one of the microstructures and the average height is calculated therefrom ("$H_{avg}$"). The average height is less than about 500 μm, less than about 400 μm, less than about 300 μm, of less than about 250 μm, less than about 200 μm, of less than about 100 μm, or even of less than about 50 μm. The microstructures are shown in a row arrangement in FIG. 2 but may also be arranged in columns or randomized patterns. In the present invention, it is likely that each microstructure will have a peak or pinnacle that contacts the skin or hair surfaces to cause the uplift prior to the rest of the microstructure's surfaces. It is expected that in most instances the top surfaces of the microstructures or peaks will be uniform in height from the base surface of the abrasion material across the entirety of the abrasion material such that it appears to have a flat surface when viewed by the human eye.

In certain embodiments, the abrasion material may also be placed alternatively on another portion of a razor cartridge surface or in addition to a location forward of the blades, e.g., rearward of the blades or along the sides of the blades, all on a top surface of the razor cartridge.

The microstructures may be formed on the abrasion material using methods known to those in the machining arts. For instance, the microstructures may be formed by embossing, electrochemical machining of base substrates, grinding, insert molding, and like methods. One suitable method for forming the microstructures is disclosed in U.S. Pat. No. 6,200,399, issued to Thielman on Mar. 13, 2001. The microstructures may be formed on an integrally formed abrasion material on a razor cartridge as well. For instance, the microstructures may be formed as a result of embossing, laser ablation, or a like surface treatment of a razor cartridge in a vicinity of abrasion material placement.

In FIG. 2, apertures 35 in the abrasion material are shown. Such apertures 35 are useful for expressing one or more conditioning agents through the abrasion material. The conditioning agent may include, but is not limited to, shaving gel, shaving cream, lotion, antiseptic fluid, fragrance, essential oils, vitamins, and combinations thereof.

Figure 4:
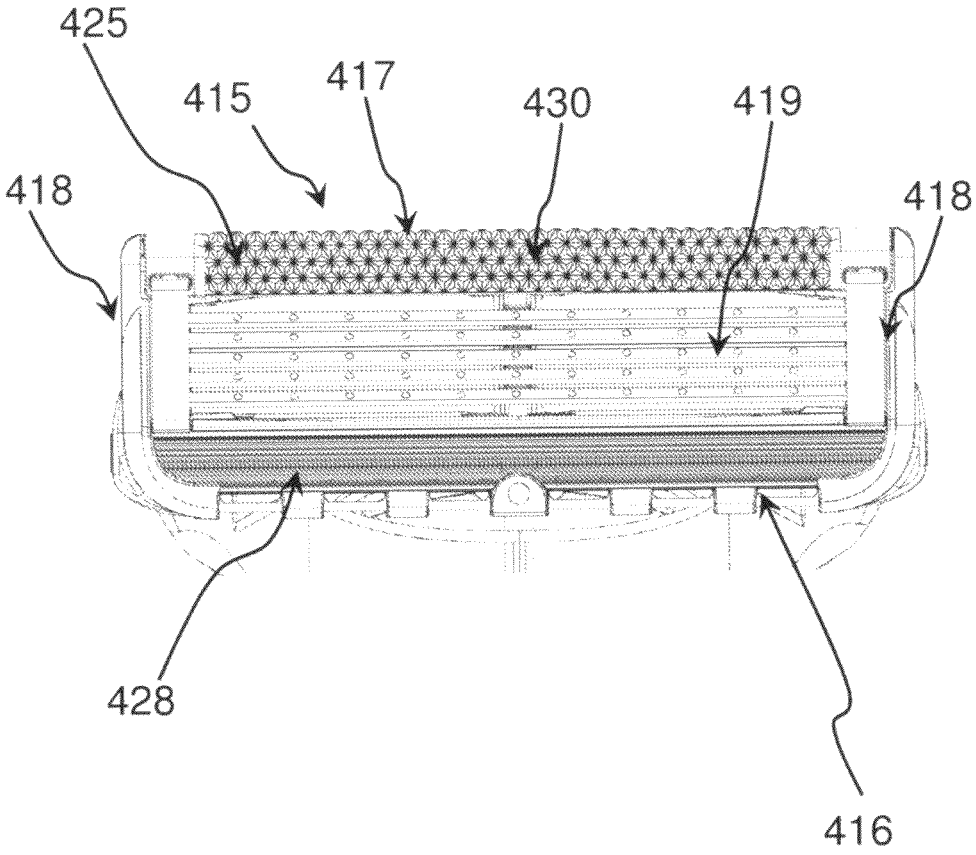
FIG. 4 shows a close up front view of another cartridge in a razor of the present invention.

Referring to FIG. 4, a cartridge 415 suitable for mounting on the handle of the razor of FIG. 1 is shown. The cartridge comprises a housing having a front wall 416, a rear wall 417, and opposing side walls 418 which join the front wall 416 and rear wall 417 to one another. A plurality of razor blades 419 are disposed in a parallel arrangement extending between the side walls 418. Each of these razor blades 419 has a sharpened cutting edge 420 on a forward facing surface of the blade. The razor cartridge 415 further includes an abrasion material 425 which comprises a plurality of geometric, three-dimensional, microstructures 430. In this embodiment, the abrasion material 425 is disposed adjacent to the rear wall 417 (near or at the cap) and rearward of the plurality of razor blades 419.

Figure 5:
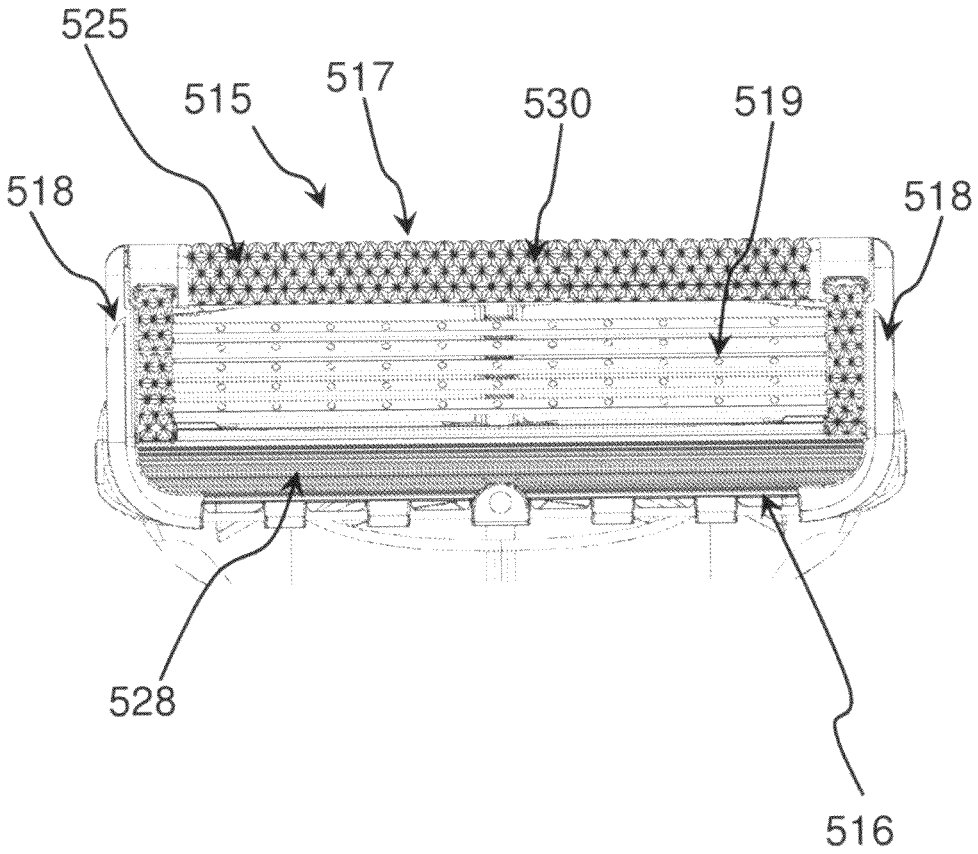
FIG. 5 shows a close up front version of yet another cartridge in a razor of the present invention.

In FIG. 5, a cartridge 515 is shown which is a further modification of the cartridge 415 of FIG. 4. This cartridge 515 also comprises a housing having a front wall 516, a rear wall 517, and opposing side walls 518 which join the front wall 516 and rear wall 517 to one another. A plurality of razor blades 519 are disposed in a parallel arrangement extending between the side walls 518. Each of these razor blades 519 has a sharpened cutting edge 520 on a forward facing surface of the blade. The razor cartridge 515 includes an abrasion material 525, which comprises a plurality of geometric, three-dimensional, microstructures 530. Here, the abrasion material 525 is disposed adjacent to the rear wall 517 (near or at the cap), rearward of the plurality of razor blades 519, and along the side walls 518. In an even alternate embodiment, the abrasion material may be apportioned into smaller sections and spread across the width of the razor cartridge, e.g., four to six individual pieces of the abrasion material with spaces interposed between the pieces.

In another embodiment, such one or more conditioning agents may be deposited in the crevices of the microstructures prior to use or during use. For instance, such conditioning agents may be impregnated and dried, the razor is then sold to the consumer who then rehydrates the razor during use releasing the conditioning agents. Alternatively, the conditioning agents may be applied in the crevices of the microstructures by dipping the razor cartridge into the conditioning agent during shaving.

Without being limited by theory, Applicant has found that the present invention seems to improve the comfort of a user during and after the shaving experience. Although the microstructures of the abrasion material effectively uplift dead skin cells as well as hair prior to and during shaving, a user is unaware of the disruption that is occurring prior to hair cutting because of the miniscule size of the structures as they are arranged in various arrays on the material. The structures give an overall feeling of smoothness to the touch by a user but still effectively lift dead skin cells and hair in need of shaving from the skin's surface in preparation for cutting. Furthermore, Applicant believes that the microstructured surface of the abrasion material enhances the overall efficiency of the shaving experience and at the same time reduces the post-shave discomfort. Such an effect may possibly be a result of the enhanced drag on the skin which then in turn causes the shaving stroke to occur more slowly. It has been observed that the razor of the present invention is particularly effective during an upstroke shave where the user drags the razor from a lower portion of the skin to be shaved, e.g., the chin, to a higher portion of the skin to be shaved, e.g., the cheek.

In certain embodiments, the microstructures of the abrasion material may actually be dulled after multiple uses. Without being limited by theory, it is believed that skin and/or hair debris accumulate in the crevices between the microstructures to result in a dulling of the reflectance and abrasiveness of the abrasion material. This dulling may manifest itself in a lessened uplift of skin and hair on the skin and/or an actual aesthetic change of the material, such that the material may not be as reflective as it had been prior to a first or previous use. That is, the dulling effect in terms of reflectance and/or reduced abrasion could serve as an indicator to change the razor cartridge.

It is also envisioned that the microstructures may be collapsible over time such that with continued use the pressure experienced during shaving would result in collapse of the structures. This collapse would serve as indicia to exchange the razor cartridge for a newer one with fully raised microstructures to obtain best shaving performance. In one embodiment, the microstructures of the abrasion material may be collapsible (or deformable) after about at least one shaving experience, or at least two shaving experiences, or at least three shaving experiences, or even greater than about three shaving experiences.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A wet shaving razor comprising:

a. a handle having a proximate and distal end;

b. a razor cartridge mounted at the proximate end of said handle, said cartridge further comprising 1) a housing having a front wall, a rear wall, and opposing side walls joining said front and rear walls;

2) a plurality of razor blades, each blade having a sharpened cutting edge and wherein said blades are disposed in a parallel arrangement extending between said side walls; and 3) an abrasion material comprising a plurality of geometric, three-dimensional, microstructures formed as a sheet wherein said abrasion material is disposed adjacent to said front wall and forward of said blades, said abrasion material comprises a base substrate and a coating which conforms to the plurality of microstructures, said base substrate comprising a dissolvable material.

2. The wet shaving razor of claim 1 wherein said coating is selected from the group consisting of aluminum, nickel, chromium, water- or other solvent based ink or paint and combinations thereof.

3. The wet shaving razor of claim 1 wherein said microstructures comprise polyhedrons selected from the group consisting of pyramids, tetrahedrons, pentahedrons, hexahedrons, septahedrons, octahedrons, and combinations thereof.

4. The wet shaving razor of claim 1 wherein said abrasion material comprises apertures.

5. The wet shaving razor of claim 4 wherein a conditioning agent is expressed through said abrasion material via said apertures.

6. The wet shaving razor of claim of claim 5 wherein said conditioning agent is selected from the group consisting of shaving gel, fragrance, essential oils, vitamins, and combinations thereof.

7. The wet shaving razor of claim 1 wherein said microstructures have an average base surface length of less than about 500 μm.

8. The wet shaving razor of claim 1 wherein said microstructures have an average height of less than about 500 μm.

9. The wet shaving razor of claim 1 wherein said microstructures are arranged in rows and/or columns.

10. The wet shaving razor of claim 1 wherein said abrasion material is secured to said cartridge by adhesive.

11. The wet shaving razor of claim 1 wherein said abrasion material is joined to said cartridge by an attachment mechanism selected from the group consisting of adhesive attachment, injection molding, ultrasonic bonding, insert molding, over-molding, and combinations thereof.

* * * * *